US005197842A

United States Patent [19]

Bross

[11] Patent Number: 5,197,842

[45] Date of Patent: Mar. 30, 1993

[54] CLOSING DEVICE FOR BINDING COMBS

[75] Inventor: Gert Bross, Waldstetten, Fed. Rep. of Germany

[73] Assignee: Chr. Renz GmbH & Co., Waldstetten, Fed. Rep. of Germany

[21] Appl. No.: 639,855

[22] Filed: Jan. 11, 1991

[30] Foreign Application Priority Data

Jan. 25, 1990 [DE] Fed. Rep. of Germany ..... 4002144

[51] Int. Cl.[5] ..... B42B 5/10

[52] U.S. Cl. ..... 412/39

[58] Field of Search ..... 412/39, 33, 38

[56] References Cited

U.S. PATENT DOCUMENTS

| | | | |
|---|---|---|---|
| 2,117,242 | 5/1938 | Eramo | 412/39 |
| 2,555,290 | 5/1951 | November | 412/39 X |
| 3,451,081 | 6/1969 | Liouville | 412/39 |
| 3,555,587 | 1/1971 | Seaborn | 412/39 X |
| 3,854,158 | 12/1974 | Pigna et al. | 412/39 |
| 4,020,516 | 5/1977 | Gomez | 412/39 |
| 4,031,585 | 6/1977 | Adams | 412/39 |
| 4,758,125 | 7/1988 | Wahl | 412/39 |

*Primary Examiner*—Paul A. Bell
*Attorney, Agent, or Firm*—Jenner & Block

[57] ABSTRACT

A closing device for the bending closure of binding combs having generally C-shaped perforating members for the comb binding of single sheets or the like has a bending tool provided with two opposing bending punches or dies. The two bending punches or dies are provided with batten-like contact elements or components which at least approximately form point- or line-shaped supports for the perforating members of the binding comb. The two upper contact elements or components are designed so that they produce a greater static friction on the binding comb. The distances of the contact elements or components are in each case adjustable with respect to one another.

15 Claims, 2 Drawing Sheets

CLOSING DEVICE FOR BINDING COMBS

TECHNICAL FIELD

The invention relates to a closing device for the bending closure of binding combs having generally C-shaped perforating members for the comb binding of single sheets or the like and more particularly relates to a bending tool provided with two opposing bending punches or dies to bend the C-shaped members.

BACKGROUND OF THE INVENTION

A closing device of this type, for example, is described in DE-OS 36 19 648. On closure of binding combs the open form is generally closed by a bending or rolling-in operation following previous insertion of the appropriate preperforated single sheets into the perforating members. During the closing operation the perforating members of the binding comb slide on the bending punch or dies. The sliding depends on a large number of factors, these impinging both on the top side opposite the top bending punch or die and on the underside opposite the bottom bending punch or die. It would be desirable, however, to have sliding and a resultant roll-in movement as far as possible only of the perforating members lying on the bottom of the bending punch or die, whereas the position of the perforating members opposite the top bending punch or die should be retained as far as possible. In practice the roll-in movement takes place more or less in an uncontrolled manner, with the top perforating members rolling themselves in pressing on the pile of sheets and in certain circumstances producing undesired impressions in the uppermost sheet.

A further disadvantage with the well-known closing devices is that several bending punches or dies are necessary for the binding of different numbers of sheets and of binding combs with different diameters. In practice eleven pairs of bending punches or dies are generally required for the sizes currently on the market. This large number of bending punches or dies represents both a problem regarding warehousing or stocking and regarding costs.

The problem of sliding conditions of the binding comb during closure is discussed in the previously mentioned DE-OS 36 19 648. An attempt was made to influence the sliding conditions by a special embodiment of at least a part of the sliding surface of the working punch or die with rolling elements or components so that binding combs were closed in a repeatable manner in a constant pre-determined profile form. The solution described, however, is relatively expensive and also successful only to a certain extent.

SUMMARY OF THE INVENTION

The present invention is therefore based on the improvement of a closing device of the type mentioned above where the change in position of a binding comb during the closing operation comes as close as possible to the ideal operation and where desired, to achieve this closing operation with a single tool even for different sizes and diameters of binding combs.

According to the invention this problem is solved in that two bending punches or dies are provided with batten-like contact elements which at least approximately form point- or line-shaped supports for the perforating members of the binding comb, with the upper contact elements or components being designed so that they produce a greater static friction with the C-shaped members of the binding comb.

Due to the only point- or line-shaped support and the higher static friction of the upper bending punch or die it is largely ensured that on closure of the bending punch or die the roll-in movement takes place only on the lower contact elements or components and only from bottom to top, whereas the upper perforating teeth adhere to the upper contact elements or components. In this way impressions, for example, are avoided in the upper sheets of a pile of sheets and, in addition, the closing movement takes place in a closed circle always regularly and repeatably.

There are a number of ways to achieve the desired higher static friction on the upper contact elements or components. For example, provision can be made for the distance between the upper contact elements or components to be greater than the distance between the lower contact elements or components.

Through this embodiment the perforating teeth, due to their C-section shape, adhere more strongly to the upper contact elements or components than to the lower contact elements or components.

Also, the upper contact elements or components can consist of a material, or be coated with a material, which produces a higher static friction than the material for the lower contact elements or components.

A very advantageous embodiment of the invention includes the provision that the distances between the contact elements or components are each adjustable with respect to one another.

By being able to set the distance and also of being able to adjust them, several sizes or diameters of binding combs can be processed with a single bending punch or die set, i.e. the device according to the invention can be optimally adjusted to the respective conditions.

One of the main advantages of this embodiment lies in the fact that much fewer pairs of bending punches or dies are required than has been the case up to now. In practice it should be possible to manage with two or three pairs of bending punches or dies.

Adjustability of the distances between the contact elements or components becomes possible by the fact that, according to the invention, the bending punch or dies split, e.g. into a base portion and a second part, which take over the actual adhesion or guiding for the binding comb.

The adjustability of the distances between the contact elements or components can be effected in various ways.

In one advantageous embodiment of the invention provision has been made for the bending punches or dies are provided with several slots running in parallel in a longitudinal direction, into which the contact elements or components designed as rails can be pushed.

This embodiment is very simple and can be made very economically. For this purpose all that is necessary is to provide several slots appropriately in a base portion of the bending punch or die, and to push, in each case, two correspondingly spaced contact elements or components into the rails at the desired spacing.

If several slots are arranged in both bending punches or dies, the most varied possibilities of combination and thus correspondingly universal possibilities of application exist for differing thicknesses and diameters of binding combs.

Instead of the use of bending punches or dies with slots, in another embodiment of the invention the distances between the contact elements or components are also adjustable by interposed, exchangeable spacer links.

In this way, too, any desired distances and thus any desired size and diameter of bending combs can be processed with a single device. For this purpose it is solely necessary to use, for example, spacers corresponding to the differing thickness or width of spacer links.

In another embodiment provision can be made for each bending punch or die to have a base portion with a stop part, with the contact elements or components with the spacer links being arranged to be exchangeable in each case between a holding part and the stop part.

For a simple design solution provision can be made for the front edge of the stop part to form a contact element of the base portion of the upper bending punch or die. In this case a component can be saved, since the stop part therefore serves a double function. Since the two upper contact elements or components have a greater distance from each other, a supporting point, preferably the rear supporting edge, can be selected as a fixed reference point, it being solely necessary to arrange the other three battens according to the desired diameter or the size of the binding comb.

Another embodiment providing for adjustability of the distance the contact elements or components of the lower and upper bending punches or dies are each connected together on the side facing away from each other by means of a hinge-like connection, in each case the opening, angle of the hinge-like connection being adjustable.

Instead of several rails, the two contact elements or components are fixed on one side, but can be arranged to be swivelled toward each other, and by adjusting of the opening angle, comb bindings of differing diameters and differing numbers of single sheets can be accommodated.

The opening angle of the hinge-type connection, through which the contact elements or components form a V-shape, can be varied infinitely or even in steps.

Stepless adjustability can be achieved, for example, by means of adjusting screws which connect the two V-shaped contact elements or components to each other.

In a simple way the interacting contact elements or components can also be held at a constant distance or with pre-tension from each other by means of a spring device, and in this way special fixing devices are avoided.

To produce as low a friction as possible of the perforating members on the contact elements or components of the lower bending punch or die and thus a light roll-in capability, provision can be made for the contact elements or components to be shaped in the form of a semi-circle or be at least rounded-off on the supporting side.

The upper contact elements or components can likewise be rounded in order to avoid more reliably impressions in the sheet pile. Also the contact elements or components can be rectangular in the form of rails or battens. In addition the battens can be knurled with grooves made radial to the diameter so that on closure the element cannot move laterally or axially.

A further reduction of the static friction is achieved if provision is made for each of the contact elements or components of the lower bending punch or die each to be provided with a rolling rod on their supporting side. Instead of a sliding movement, in this way a rolling friction is generated, which is a substantially lower friction.

Below, the various embodiments of the invention are described in principle with the aid of the drawing of embodiments of the invention.

DETAILED DESCRIPTION OF THE INVENTION

Binding comb devices for the closure of a binding comb blank or of a binding comb pre-fabricated from round wire are generally well known, which is why only those parts essential to the invention are described.

Figure 1:
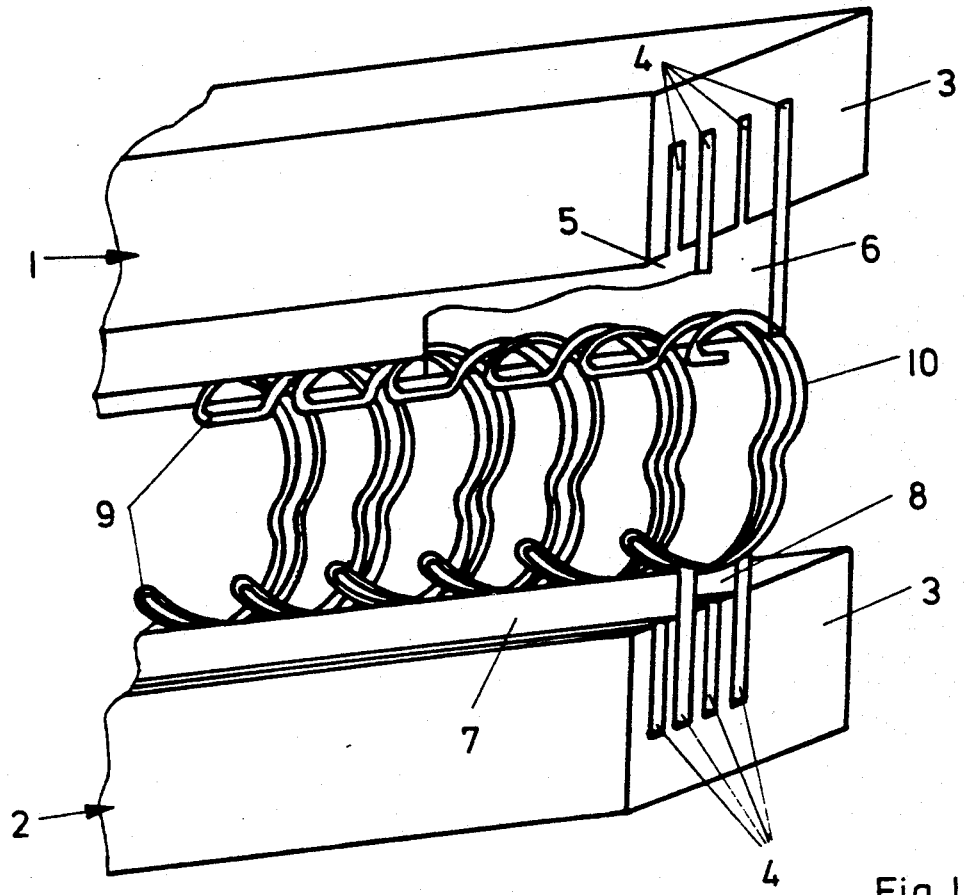
FIG. 1 illustrates bending punches or dies according to the invention, in a closing device in perspective representation.

A closing device of FIG. 1 has two bending punches or dies arranged in a machine frame, that is, an upper bending punch or die 1 and a lower bending punch or die 2, which are generally movable towards each other in the direction of the arrow for closure by a hydraulic or pneumatic device (not shown).

Each bending punch or die 1 or 2 has a base portion 3, which is provided with several slots 4 arranged parallel at a distance from one another, which extend in the longitudinal direction of the bending punch or die 1 or 2. In the embodiment shown, four slots each are provided, but of course within the framework of the invention it is also possible to provide more slots 4.

A pair of contact elements or components 5 and 6 are inserted into the slots 4 of the upper bending punch or die 1, and a pair of contact elements or components 7 and 8 are inserted from below or from the side into the slots of bending punch or die 2. Contact elements or components 5 to 8 can be held in slots 4 through a press fit or by other fastening means.

As can be seen from FIG. 1, the distances between the slots 4 in the upper bending punch or die 1 are larger than the distances of the slots 4 in the lower bending punch or die 2. If the contact elements or components 5 to 8, shaped like strips or rails, are pushed accordingly in the same way into the slots such that each slot located between them remains free, the two contact elements or components 5 and 6 lie in the upper bending punch or die 1 at a greater distance from each other than the two contact elements or components 7 and 8 in the lower bending punch or die 2.

It goes without saying that within the framework of the invention, however, the distances between the slots 4 may also be the same in each case in the lower and the upper bending punches or dies 1 or 2. In this case correspondingly more free slots are provided between the contact elements or components 5 and 6 in the upper bending punch or die 1 than between the contact elements or components 7 and 8 in the lower bending punch or die.

A prerequisite for positioning the contact elements or components 5 to 8 is solely that the two contact elements or components 5 and 6 have a greater distance from each other than the contact elements or components 7 and 8.

As can be seen, a set of perforating members 9 of a binding comb 10 each lie point- or line-shaped on the contact elements or components 5 to 8. In other words this also means that the binding comb 10 with its numerous perforating members 9 in each case rests only at four points. A guiding surface—as is the case with the prior art—is no longer necessary, since due to the distance arrangement of the contact elements or components according to the invention and their narrowness, proper guiding of the binding comb is ensured. In particular, during the roll-in movement of the binding comb 10, after a pushing in of the single sheets previously perforated and to be bound to one another by the perforating member 9, only the lower perforating member 9 move upwards because of the substantially lesser friction of the contact elements or components 7 and 8 compared with the perforating member 9, which rest with a greater static friction on the contact elements or components 5 and 6 of the upper bending punch 1. The position of the upper perforating member 9 remains essentially unchanged or changes only slightly.

Figure 2:
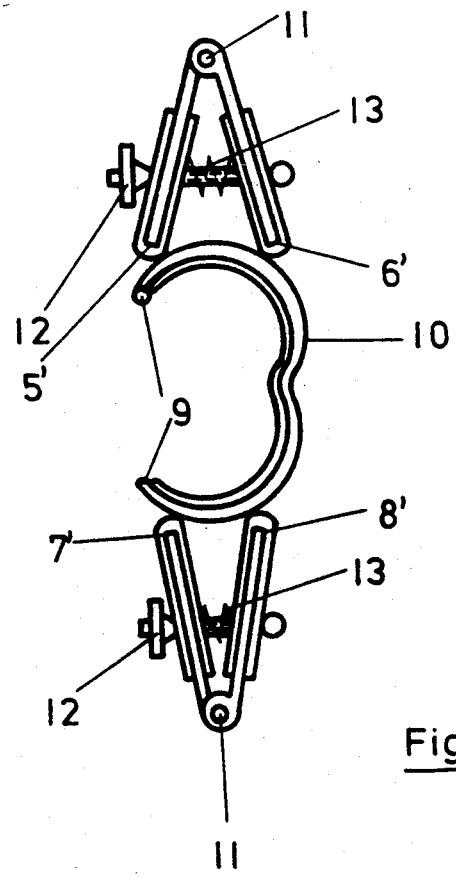
FIG. 2 is a side view of a second embodiment of the invention.

Shown in FIG. 2 is another embodiment regarding adjustability of the distance of the contact elements or components 5'to 8'. As can be seen, in each case the contact elements or components 5', 6', 7' and 7' are connected to one another and pivoted on the side facing away from the binding comb by means of a hinge-like connecting piece 11. The hinge-like connecting piece 11 can be connected in any desired way, not described in greater detail, to the base portion 3 of the particular bending punch 1 or 2 concerned. The setting and the adjustment of the distance between the contact element or component 5' and the contact element or component 6' or the contact element or component 7' and the contact element or component 8 on the front side are accomplished by means of an adjusting screw 12, which pass right through the two contact elements or components in each case working together. The adjusting screw 12 can, for example, be provided with a grub screw and an adjusting nut. To maintain an exact opening position, the contact elements or components 5', 6', 7' and 8' working together in each case can be held by an interposed spring unit 13 under pre-tension. By an appropriate twisting of the adjusting screw 12 or of the adjusting nut, the opening angle of the hinge-like connecting piece can be infinitely varied accordingly and thus also the distance of the two contact elements or components 5', 6', 7' and 8' in each case working together, in the area of the support for the perforating members 9.

Figure 3:
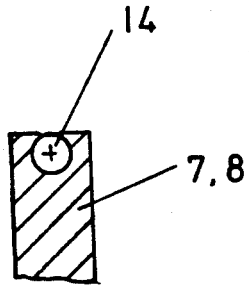
FIG. 3 is an enlarged side view of a contact element with a rolling rod.

FIG. 3 shows the front area of a contact element or component 7 or 8 in a side view, whereby a rolling rod 14 is introduced into a corresponding recess in the area of the support for the binding comb 10. The rod is rotatable about an axis which runs parallel to the longitudinal direction of the contact elements or components. In this way the friction between the perforating teeth 9 and the lower contact elements or components 7 and 8 is reduced.

Figure 4:
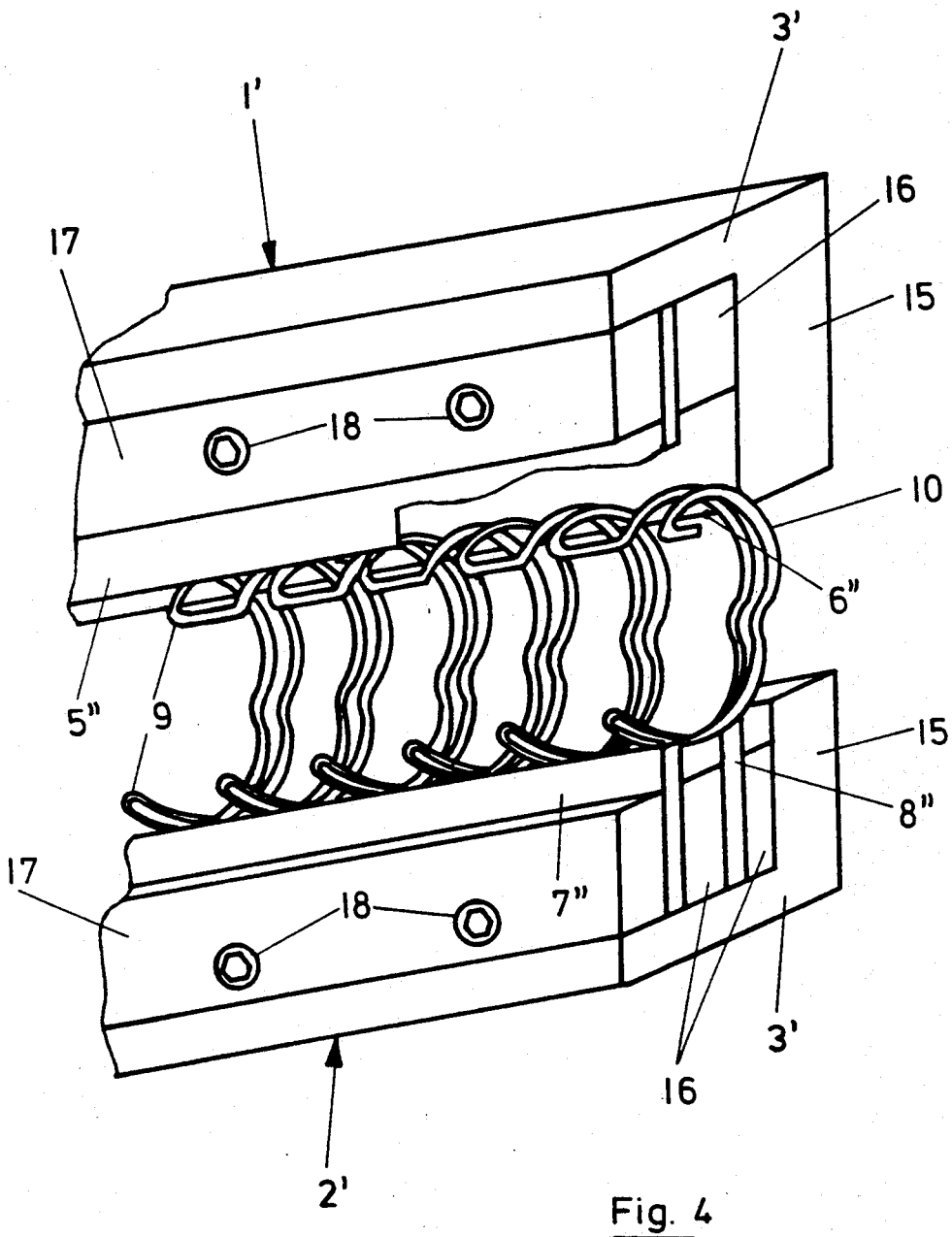
FIG. 4 illustrates another embodiment of two bending punches or dies according to the invention, in perspective representation.

Shown in perspective in FIG. 4 is an embodiment similar to the representation in FIG. 1, of a closing device for binding combs, with each bending punch 1' or 2' having a base portion 3' in the form of an angle or an L. The position of the angle-shaped base portion is selected in each case so that one leg lies horizontal whereas the second leg runs in a vertical direction, namely in each case in the direction of the other bending punch. The respective vertical leg forms a stop portion 15.

The respective horizontal legs of the base portion 3 form supporting or bearing surfaces for the bar or strip-shaped contact elements or components 5", 6" and 7", 8". The rear contact element or component 6 of the upper bending punch 1 is formed by the front edge of the contact element or component 15.

As can be seen, between the contact elements or components 5", 6" and 7", 8" and the stop elements 15, spacer elements or components 16 are arranged, which have differing thicknesses or widths. The width of the spacer elements 16 should be selected depending on the size or diameter of the binding comb 10, it being necessary to make sure that the distance between the two contact elements or components 5", 6" is greater than the distance between the two lower contact elements or components 7", 8".

By means of an external holding element 17 the individual parts are connected together as one unit or the contact elements or components 7", 8" and the contact element or component 5" with the interposed spacer elements 16 secured onto the respective stop element 15 of the base portion 2'. The parts used for this are preferably hexagon socket head cap screws 18 which are inserted through the contact elements or components 5", 7" and 8" and the spacer elements 16 and screwed into the stop elements 15.

As can be seen, in this way a simple exchange and thus adaptation of the device to different sizes and diameters of binding combs 10 is possible. For this purpose the hexagon socket head cap screws 18 are removed and the adapted spacer elements 16 placed in the correct relationship, after which a firm connection is again secured by the hexagon socket head cap screws 18.

I claim:

1. A closing device for the bending closure of binding combs having generally C-shaped perforating members for the comb binding of single sheets, comprising: an upper and a lower opposing bending die, wherein each of said bending dies are provided with a pair of contact elements which provide support for the perforating members of the binding comb, wherein said upper contact elements have a greater static friction with respect to the perforating members than said lower contact elements.

2. The closing device according to claim 1, wherein the distance of said upper contact elements from each other is greater than the distance of said lower contact elements from each other.

3. The closing device according to claim 1, wherein said contact elements include materials which result in a greater static friction between said upper contact elements and the perforating members than the material for the lower contact elements.

4. The closing device according to claim 1, including adjusting means for adjusting the distances of said contact elements with respect to one another.

5. The closing device according to claim 4, wherein said dies are configured with a plurality of slots running parallel to one another and in longitudinal direction, into which said contact elements are inserted.

6. The closing device according to claim 4, wherein the said adjusting means includes interposed, exchangeable spacer elements.

7. The closing device according to claim 6, wherein each said die has a base portion with a stop element, said contact elements being located such that they cooperate with said stop element to hold the binding comb.

8. The closing device according to claim 7, wherein the front edge of said stop element forms a contact element.

9. The closing device according to claim 4, wherein said adjusting means includes a hinge connecting said contact elements on said upper and lower dies and wherein said hinge is adjustable.

10. The closing device according to claim 9, wherein the opening angle of said hinge is adjustable.

11. The closing device according to claim 9, wherein said contact elements connected to each other by said adjusting means are connected adjustably to each other by an adjusting screw.

12. The closing device according to claim 9, wherein said associated contact elements are held at a distance from each other by a spring device.

13. The closing device according to claim 1, wherein the surfaces of said contact elements supporting the perforating members are rounded.

14. The closing device according to claim 1 wherein the surfaces of said contact elements secured to the lower die supporting the perforating members include a rolling rod.

15. The closing device according to claim 1, wherein the surfaces of said contact elements supporting the perforating members are configured with grooves.

* * * * *

UNITED STATES PATENT AND TRADEMARK OFFICE

CERTIFICATE OF CORRECTION

PATENT NO. : 5,197,842

DATED : March 30, 1993

INVENTOR(S) : Gert Bross

It is certified that error appears in the above-identified patent and that said Letters Patent is hereby corrected as shown below:

Column 3, line 32, after "opening" delete the comma ","

Column 5, line 28, delete "7'" (second occurrence) and insert therefor --8'--; and line 38, delete "8" and insert therefor --8'--

Signed and Sealed this

Thirtieth Day of November, 1993

Bruce Lehman

BRUCE LEHMAN

*Commissioner of Patents and Trademarks*

*Attest:*

*Attesting Officer*